United States Patent [19]

Becicka et al.

[11] Patent Number: 5,046,303

[45] Date of Patent: Sep. 10, 1991

[54] AUTOMATED SYSTEM FOR PALLETIZING/UNITIZING UNSTABLE ARTICLES

[75] Inventors: Kenneth F. Becicka, Alvin; Neal C. Chamberlain, Hoopeston; Thomas R. Reed; Russell J. Hurliman, both of Danville, all of Ill.; Bahman Daneshjoo, Warren, Mich.

[73] Assignee: FMC Corporation, Chicago, Ill.

[21] Appl. No.: 525,791

[22] Filed: May 18, 1990

[51] Int. Cl.[5] ..... B65B 11/04; B65B 35/50

[52] U.S. Cl. ..... 53/540; 53/556; 53/587; 414/907

[58] Field of Search ..... 53/447, 441, 556, 540, 53/587, 588; 414/788.9, 792.2, 792.3, 907

[56] References Cited

U.S. PATENT DOCUMENTS

| | | | |
|---|---|---|---|
| 3,994,114 | 11/1976 | Nishimura | 53/447 |
| 4,457,656 | 7/1984 | Kosina | 414/792.2 |
| 4,500,001 | 2/1985 | Daniels | 414/907 X |
| 4,546,793 | 10/1985 | Lasscock | 53/441 |
| 4,593,517 | 6/1986 | Mattila | 53/556 X |
| 4,607,476 | 8/1986 | Fulton, Jr. | 53/587 X |

FOREIGN PATENT DOCUMENTS

| | | | |
|---|---|---|---|
| 2216489 | 10/1989 | United Kingdom | 53/556 |

*Primary Examiner*—John Sipos

*Attorney, Agent, or Firm*—Douglas W. Rudy; Richard B. Megley

[57] ABSTRACT

A palletizer, having a stacking and article wrapping station, includes a rotatable circular plate having a rectangular opening therein for accommodating unstable articles as they are being stacked. The rectangular opening includes article guides which will support a stacked layer of articles prior to and during the wrapping of the articles.

3 Claims, 7 Drawing Sheets

AUTOMATED SYSTEM FOR PALLETIZING/UNITIZING UNSTABLE ARTICLES

BACKGROUND OF THE INVENTION

1. Field of the Invention

This invention has to do with material handling equipment generally known as "palletizers". Palletizers are automated devices that provide for the accumulation of articles on a shipping pallet in a vertical stack so that the stack of articles can be, and is, consolidated for shipping or transportation to a subsequent location.

An enhancement of the simple stacking and palletizing of articles includes the wrapping of the stack in stretch wrap film, shrink wrap film, or other film that surrounds the stacked articles and gives the palletized load a unified structurally more secure stack.

2. Description of Related Art

As stated above it is known to stack articles on pallets and wrap the palletized stack in film. FMC Corporation, the assignee of this invention provides a commercial unit known as a STACK WRAP automatic palletizer/stretch wrapper that combines the palletizing and stretch wrapping technologies in a single machine that has the ability to wrap articles on a pallet as the articles are being stacked. This machine is a state of the art unit that is most closely related to the instant invention. Other stacking and wrapping schemes and machines exist including machines that are provided with guide means or stabilizer means that hold the stack of articles while they are being wrapped. This invention includes the provision of a stack stabilizing device in the stretch wrapping and stacking zone to restrain the stack as it is being wrapped.

SUMMARY OF THE INVENTION

This invention is a system of stacking and stretch wrapping articles that are normally unstackable using equipment known today. Such unstable articles are processed through an accumulating zone, an alignment zone, possibly an upending zone, and to a stacking and wrapping zone. In the stacking zone such unstable articles may be restrained by a restraining device which will restrain the unstable articles until they are wrapped with stretch wrap material or other wrap means.

DESCRIPTION OF THE PREFERRED EMBODIMENT

The invention presented herein includes multiple zones where operations may be performed on articles to be stacked and wrapped at a single work station or zone. Although a preferred embodiment is presented here the invention can be practiced in other embodiments which may be less sophisticated while still adequate to do a quality job in stacking and wrapping of articles. Part of the utility of this invention is that it can be used for stable article stacking and wrapping even though it is designed to stack and wrap unstable articles which have heretofore been difficult, if not impossible to wrap as they are stacked.

Figure 1:
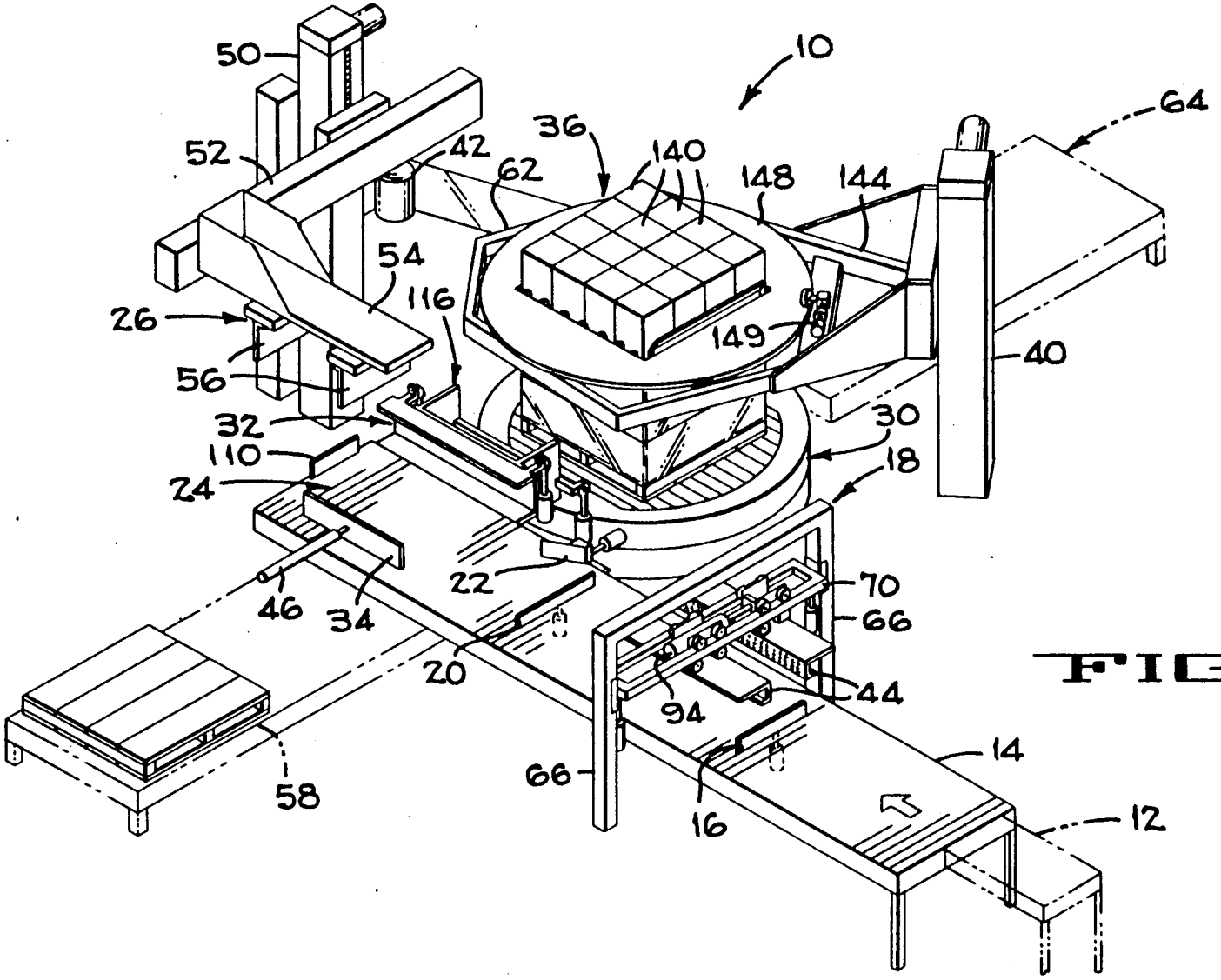
FIG. 1 is a perspective view of a simplified representation of the invention.

The overall general concept of the invention is set forth in the rather simplistic presentation shown as FIG. 1. In this figure an unstable article stacking and wrapping station, generally 10, is presented. In this illustration articles to be stacked and wrapped will be delivered to a powered roller conveyor 14 where they can be temporarily restrained by means of a preaccumulation stop 16 until a quantity of articles are accumulated or until the system directs the preaccumulation stop to be retracted so that articles can pass into the next zone, the double stacker zone, of the system.

A double stacker, generally 18, bridges the powered roller conveyor 14 in what has been termed the double stacker zone. This zone would generally be that area between a double stacker stop 20 and and preaccumulation stop 16. The double stacker 18 allows the accumulation of a row of articles, held by the double stacker stop 20, the accumulated articles are then lifted above the conveyor. A second set of accumulated articles is then accumulated behind the double stacker stop 20. When the predetermined number of articles are accumulated the double stacker generally 18 will lower to deposit the articles it has held on top of the articles on the powered conveyor 14. The double stacker stop 20 is then lowered and the double stacked articles pass to the next zone in the system.

In transit to the next zone the articles may, depending on the program of the system, encounter a turn lug 22. The turn lug 22 can be positioned to stop one side of the article (if one article is being conveyed) or a preaccumulated row which causes or allows the opposite side of the articles to be driven around by or through contact with the powered roller conveyor. This results in a ninety degree turn of the articles on the conveyor.

The next zone where the articles are restrained is the pickup zone generally 24. This zone is accessible by a cartesian style palletizer, generally 26, which is of a type known in the art. It will grip, left and place partial or full layers on a pallet on the turntable generally 30. The palletizer will cycle through multiple pickup and deposit cycles until a full pallet of articles is stacked.

In the pickup zone 24 an upending device, generally 32 may operate in conjunction with a pusher means 34. These apparatuses operate in conjunction to upend articles that are to be stacked standing on their ends. This apparatus will be discussed further on.

In the case where articles are to be stacked on the pallet in the stack and wrap zone in an upending configuration, or where unstable articles are to be stacked on a pallet, a restraining device, generally 36 has been provided to stabilize the placed articles until a "wrap" of film can be positioned around them. The restraining device is a rather shallow apparatus cantilevered from an elevator post 40 which is capable of elevating or lowering the restraining device 36 as the stack of unstable product or articles is being "built".

Stretch wrap, in the case of a preferred embodiment, is let off a roll of film 42 as the turntable rotates the palletized articles.

Figure 2:
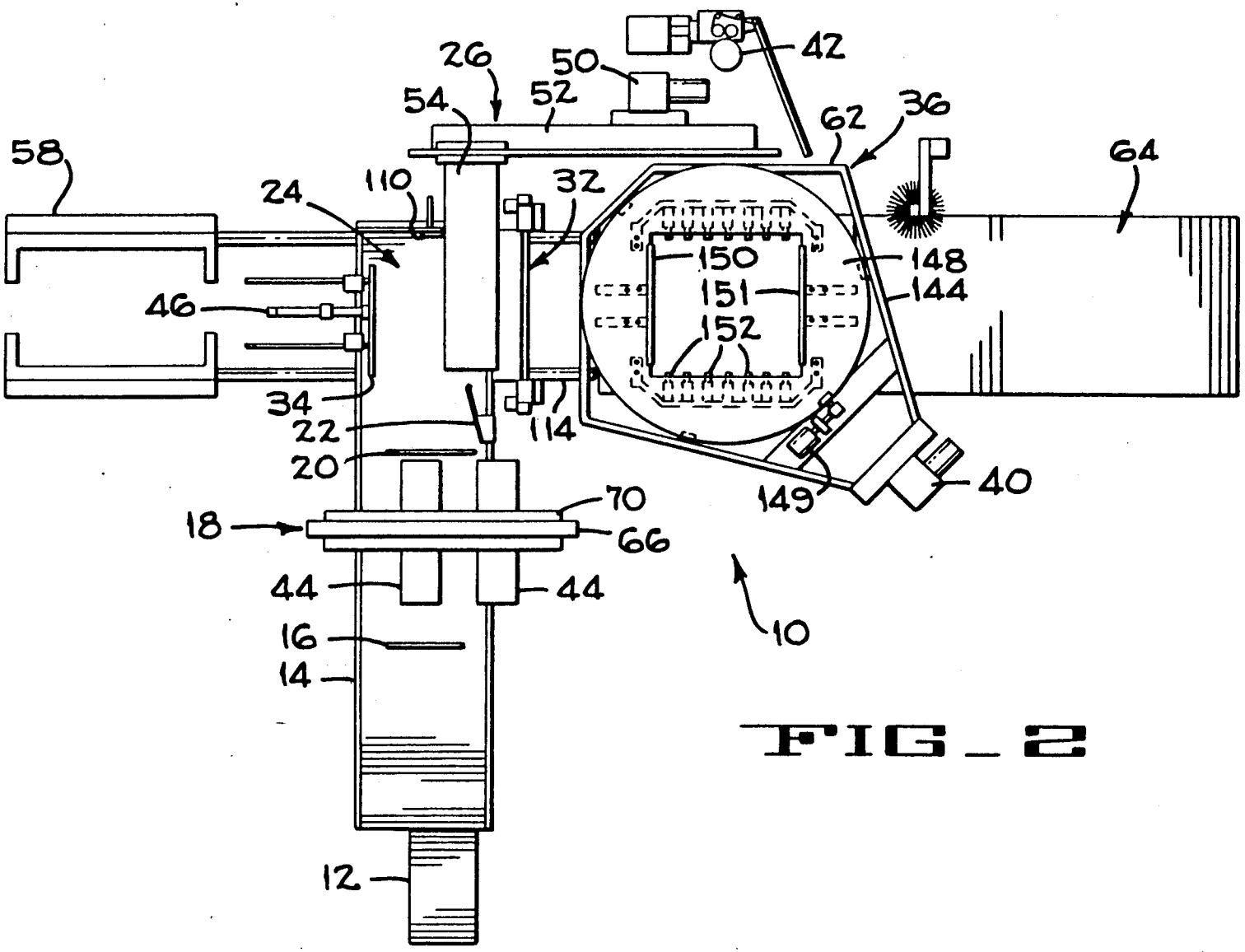
FIG. 2 is a top view of the invention showing the processing zones of the invention.

A top view of a stack and wrap system which incorporates a double stacker, an upender and a restraining device in the stack and wrap zone is shown in FIG. 2. Here an infeed conveyor 12, usually of a belt type is positioned to feed articles to the powered roller conveyor 14. The double stacker 18, with its palms 44 for gripping a row of articles, is located between the preaccumulation stop 16 and the double stacker stop 20. The turn lug 22 is located immediately upstream of the pickup zone 24.

In this overhead view the pusher means 34 can be seen to be a plate attached to the end of a cylinder means 46, which can be air operated, hydraulically operated or electrically operated and will stroke such that the plate urges rows of articles toward the upending device 32.

The cartesian style palletizer, generally 26, includes a vertical mast 50, a boom 52 transverse to the mast and elevatable upwardly and downwardly along the mast 50, and a hand support 54. A hand 56 is carried on the hand support and is the qripping means that grips the articles accumulated in the pickup zone for delivery to the appropriate position on the pallet carried on the turntable.

Shown in this view is a pallet serving device generally 56 which is used to store pallets and supply them to the turntable as necessary.

Clearly shown in this view is the restraining device 36 which includes an elevator post 60 and the frame of the restraining device 62 which will be described in more detail further on.

A full pallet accumulation zone, generally 64, as well as other elements not described, is also apparent in this figure.

Figure 3:
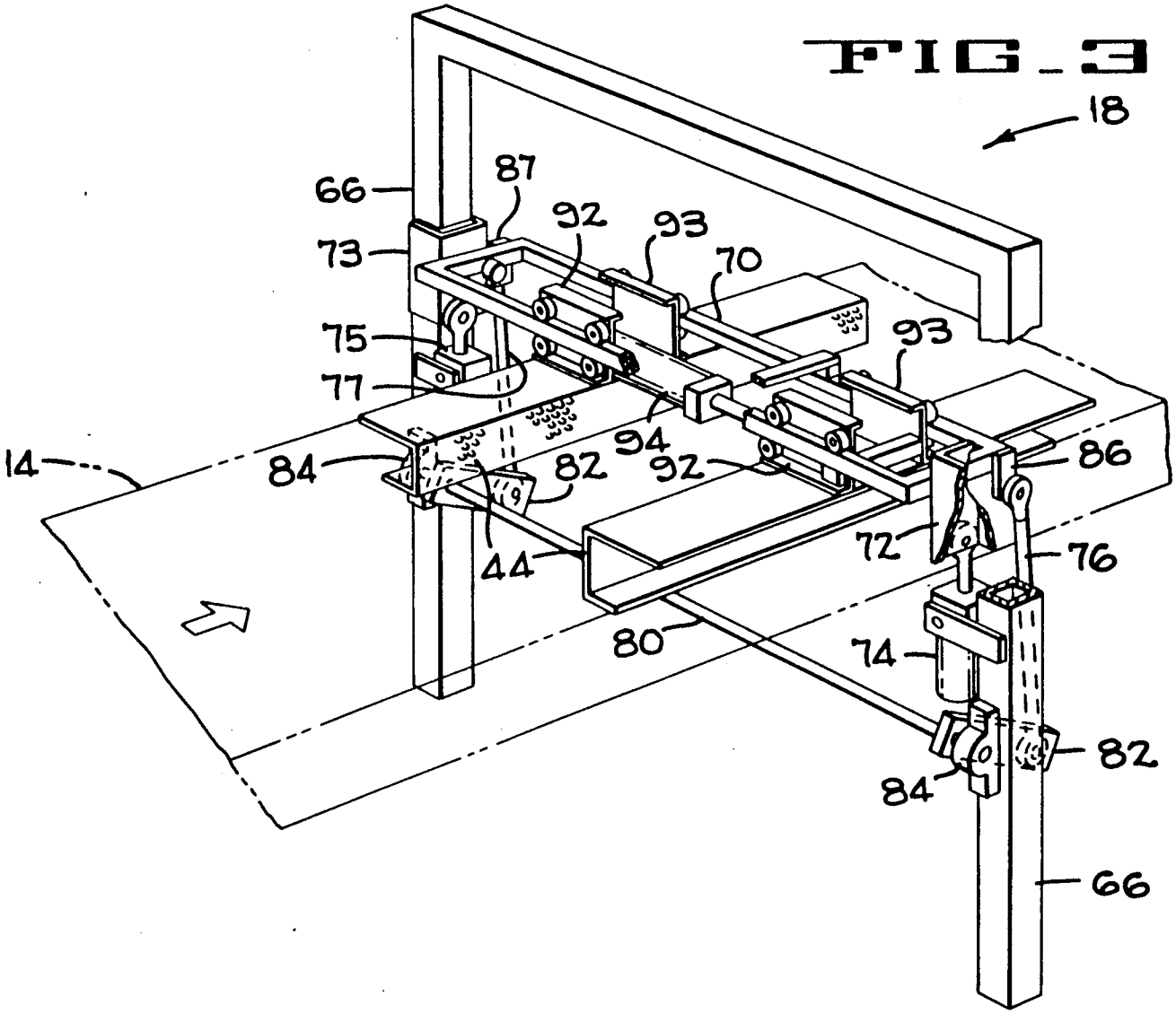
FIG. 3 is a projection view of a portion of the double stacker zone of the invention with some parts broken away and sectioned.

A more detailed description of various elements of the invention may serve to further the understanding of the invention. Thus, FIG. 3 is presented to show the double stacker, generally 18, in more detail. A floor supported frame 66 supports the elevatable frame 70 above the conveyor 14. The elevatable frame 70 includes guide means 72 and 73 at each end of the elevatable frame which are in slidable contact with uprights of the frame 66. The elevatable frame 66 is urged upwardly by fluid operated cylinders such as 74 and 75 at each end of the elevatable frame. A linkage made up of vertical links 76 and 77, connected to a transverse bar 80 through links such as 82 and secured to the frame 70 through blocks such as 84 helps to prevent the elevatable frame 70 from binding as it is raised or lowered since the linkage is attached at the opposite ends of the elevatable frame at points 86 and 87.

A pair of gripping palms, 90 and 91, are carried on trolleys 92 and 93 which will be urged toward each other by means of a fluid operated cylinder 94 to trip the articles accumulated on the roller conveyor between them and then to hold the articles as the elevatable frame 70 is raised by means of the fluid operated cylinders 74 and 75 so that another set of articles can be accumulated below the elevated set. When the second set of articles is in position the elevatable frame 70 will be lowered, the palms spread and the now double stack of articles will be ready to be moved by the powered conveyor, after lowering of the double stack stop to the next zone.

Generally, the turning lug is only optionally used and most often will not be used when double stacked product is being processed through the system.

Figure 4:
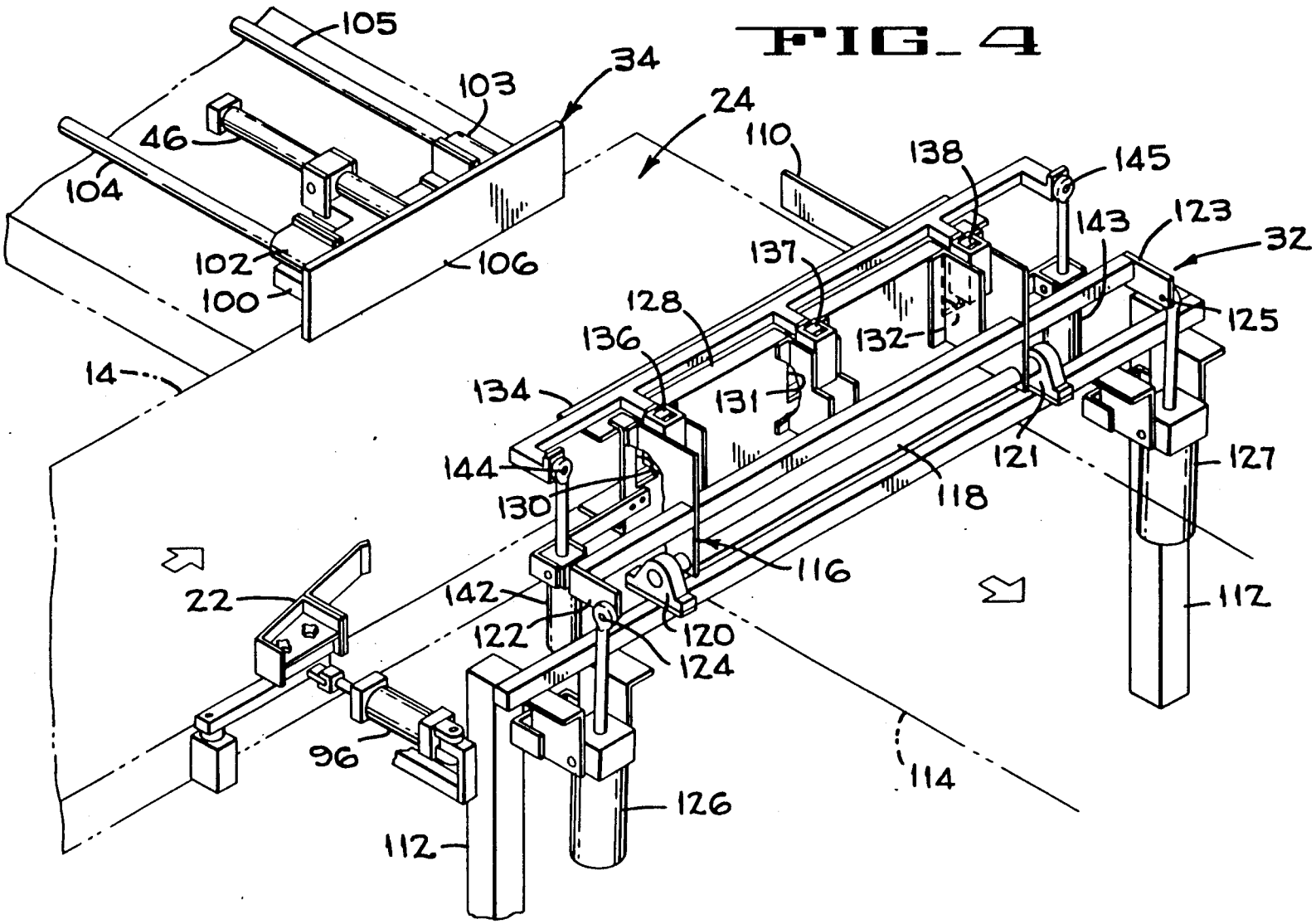
FIG. 4 is a projection view of a portion of the upending device zone of the invention with some parts broken away and sectioned.

Looking now at FIG. 4, which shows the pickup zone 24 of the system as well as the turning lug 22 which is pivotally displaceable from an inactive position as shown to a functioning position by means of a fluid cylinder 96 connected to the back side of the turning lug 22. The operation of the turning lug is obvious from FIG. 4 and is known in the art.

More detail on the pusher means 34 can be seen in FIG. 4. The cylinder means 46 is secured to a fixed beam 100 which also supports blocks 102 and 103 which, through guide rods 104 and 105, prevent the face plate 106 of the pusher means from becoming "cocked" in operation.

Articles being fed through the system will be stopped at the end of the powered conveyor 14 by means of a restraint 110 which is permanently mounted in this preferred embodiment.

Figure 6:
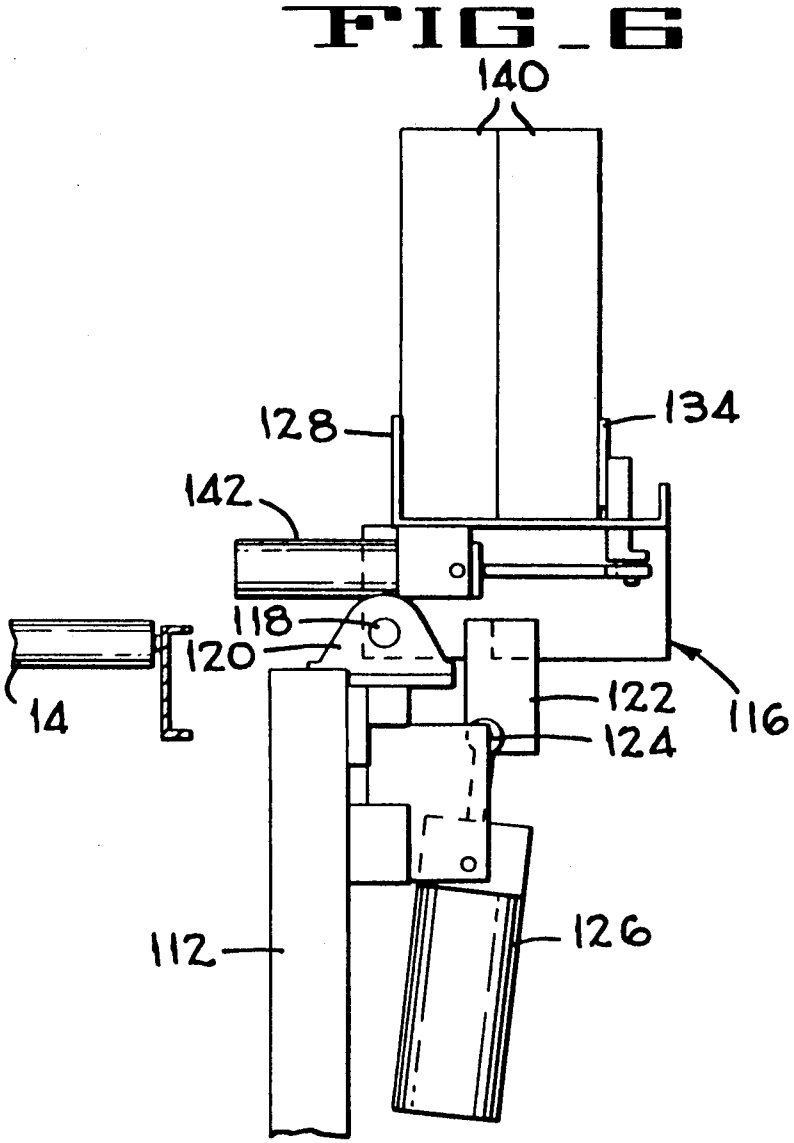
FIG. 6 is a side elevation view of the upending device shown in FIG. 5 with the device and several stacked articles shown in an upended displacement.
Figure 5:
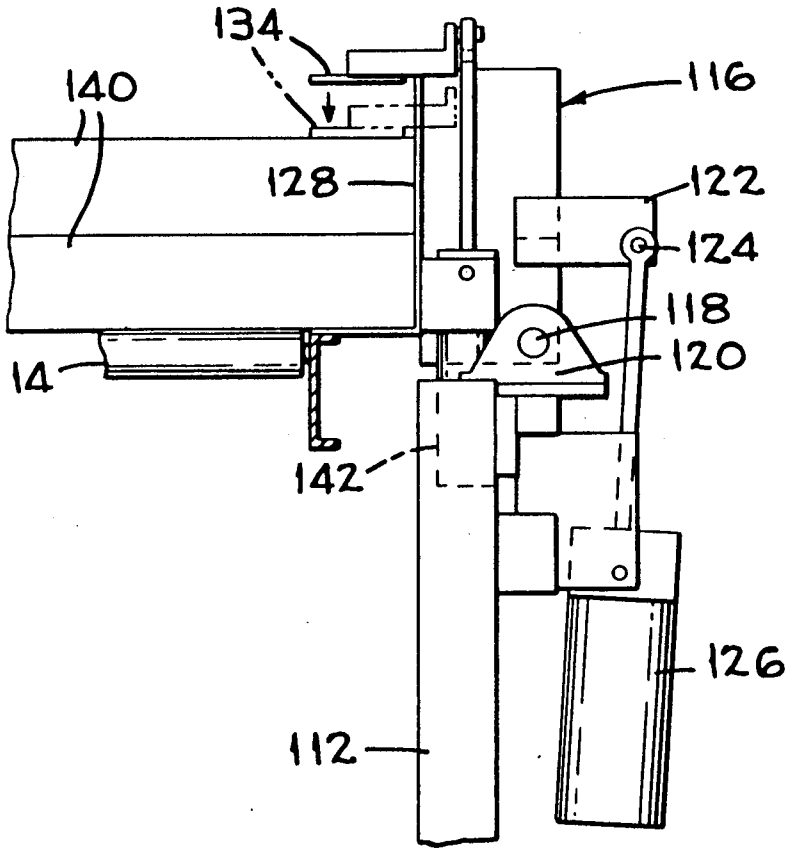
FIG. 5 is a side elevation view of the upending device shown in FIG. 4 with some parts broken away and other parts sectioned.

The upending device, generally 32, is best understood by looking at FIGS. 4, 5 and 6 wherein like reference characters represent like components. The device consists of a frame 112, generally shaped as a bridge and supported on the floor. An empty pallet serving conveyor 114 is bridged by the frame 112. A secondary frame 116 is pivotally mounted to the frame 112 on an axle or beam 118 suspended on bearing blocks 120 and 121. The secondary frame 116 includes links 122 and 123 which are connected at pivot points 124 and 125 to rod ends of fluid operated cylinders 126 and 127 which are gimbal mounted, that is, pivotally mounted, to the frame 112 proximate to the outboard ends of the links 122 and 123.

The secondary frame 116 includes a wall means 128 which has a somewhat "ell" shaped cross section as best seen in FIG. 5. Movable mounted through slots 130, 131 and 132 is a clamp plate 134. The clamp plate 134 also incorporates weights 136, 137 and 138 that assist in holding the clamp plate 134 against articles such as 140 when such articles are to be upended. The clamp plate 134 is urged to and from the bottom surface of the wall means 128 of the secondary frame 116 by means of fluid cylinders 142 and 143 which are fixedly mounted to the wall means 128. The cylinder rams of the fluid cylinders 142 and 143 are attached to the clamp plate 134 at the outboard ends thereof such as 144 and 145.

In FIG. 5 the edge of the powered roller conveyor 14 and more specifically, the frame of the conveyor is shown proximate to the lower portion of the wall means 128. In FIG. 6, which shows the articles upended it can be seen that the wall means has pivoted away from the edge of the conveyor. It is at this station and in this position, i.e., the articles 140 tipped on end, when and where the palletizer would pick up the articles and stack them on the pallet on the stack and wrap turntable. In order to get the articles 140 into the "bite" of the upender the pusher means 34 was actuated to push the articles from the "normal" position on the conveyor to a position where the ends of the articles are between the wall &two surfaces) and the clamp plate 134.

As an aside it should be noted that it is not necessary to upend articles before they are stacked. If preferred articles could be picked up from a "flat" position and stacked as commonly done. If that option were chosen the upender 32 would be pivoted to its upright position and the palletizer would pick up articles from the surface of the conveyor rather than from the upender.

Figure 7:
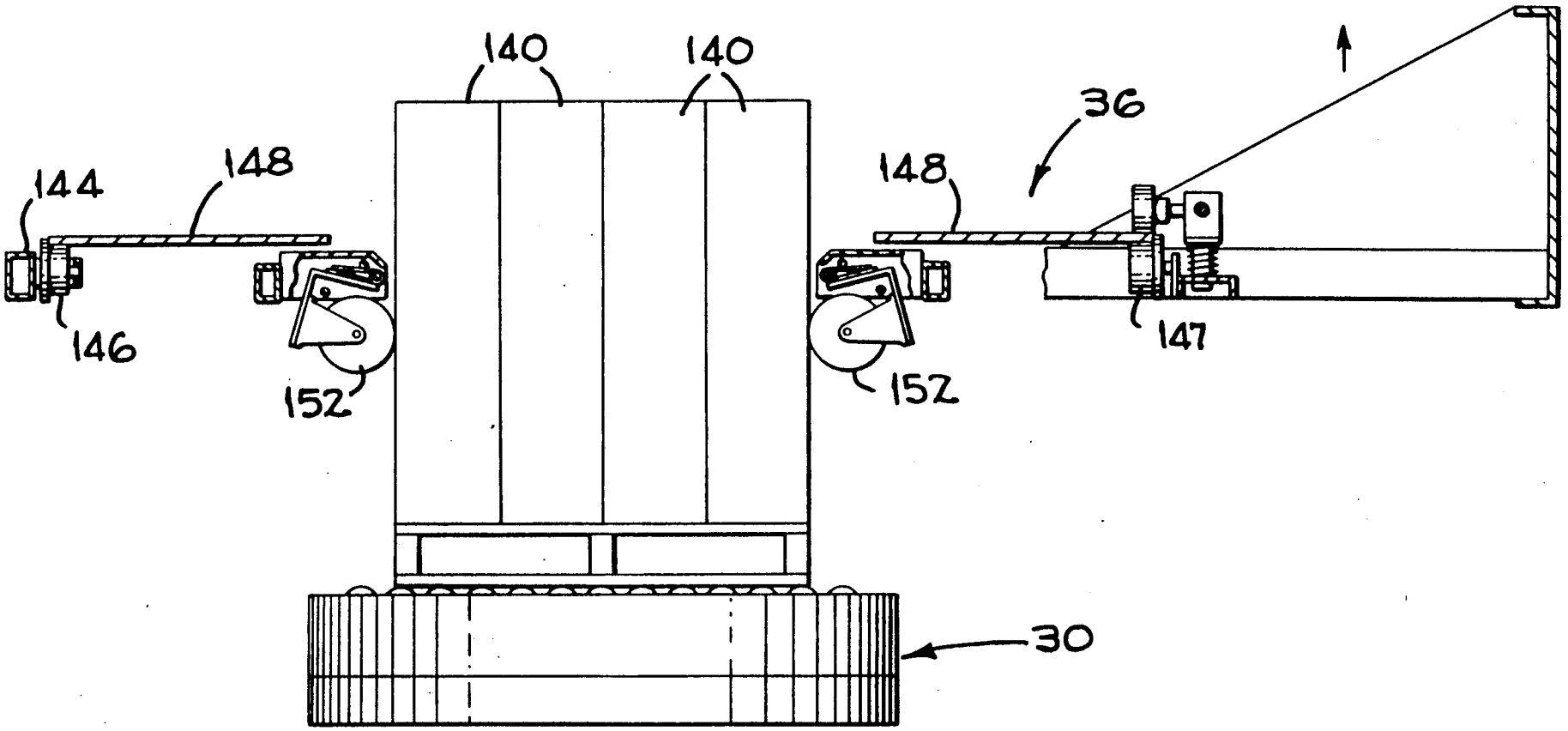
FIG. 7 is a pictorial representation of a portion of the restraining device zone of the invention with some parts broken away and other parts sectioned.
Figure 8:
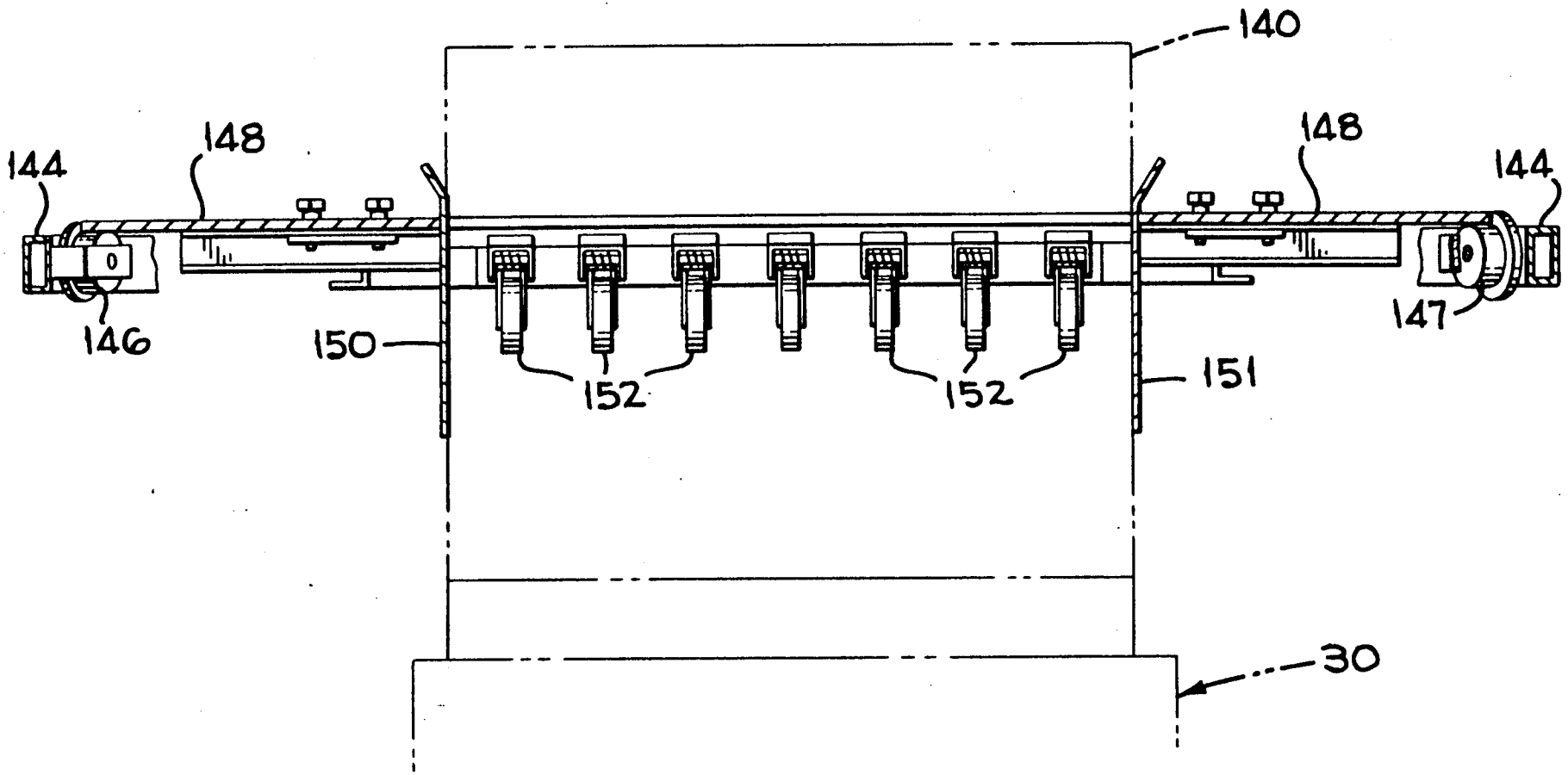
FIG. 8 is a pictorial representation of the restraining device in elevation with some parts broken away and other parts sectioned.

FIGS. 7 and 8 show, in a pictorial presentation with some parts removed for clarity and others sectioned and/or broken away, how a group of articles 140, which have been stood on end are restrained in position by the restraining ring generally 36.

Looking first at FIG. 8 the general construction of the restraining ring 36 can be appreciated. A frame 144 is a closed geometric shape, refer to FIGS. 1 and 2, that provides support for rollers such as 146 and 147 which in turn support a plate 148 having a round circumference. The plate 148 has a large rectangular hole through it, large enough to accommodate a pallet size load which is usually 48"×48". The plate 148 is like a turntable and will be rotated in synchronization, or non-synchronized coordination, with the pallet supporting turntable generally 30. A separate drive motor (not shown) is used to drive the plate 148 when the pallet supporting turntable is rotated.

In FIG. 8 edge guides 150 and 151 are shown. These edge guides define opposite sides of the rectangular opening in the plate and provide static stabilizers to a stack of articles stacked on the pallet turntable 30. The two other sides of the rectangular opening in the plate 148 are occupied by a series of pivotable spring mounted rollers such as those shown as 152 in FIGS. 7 and 8. These rollers 152, and there are pluralities of them on opposite sides of the rectangular opening in the plate 148, serve to stabilize the upended articles, such as 140, which can be very unstable, until they are wrapped by the conventional wrapping means of the stack and wrap palletizer.

The operation of the unstable article palletizer and wrapper is as follows.

Articles are conveyed to the system on a powered roller conveyor with the longest dimension laying down on the conveyor. The articles are metered into the system by a belt conveyor 12 which may have a rough belt surface to add in restraining articles and feeding them. Gaps between articles are created as they enter onto the powered roller conveyor 14 which is running at a faster speed than the infeed conveyor 12. These gaps are necessary if the articles are to be turned by the turning lug 22 downstream.

Because of the various palletizing patterns that could be formed various different mechanisms are located sequentially along the roller conveyor 14. Any combination of these are used to preform a partial layer of articles. First is the preaccumulation stop 16 for accumulating a row of articles. The stop is typically an air actuated blade which passes upward between the conveyor rollers to hold an article from passing farther down the conveyor 14. After a row is accumulated, the stop drops down to release the row to the double-stacker stop 20. Here the row is lifted above the conveyor 14 to allow a second row to pass underneath, after which the double stacker stop 20 drops to release two rows stacked one on top of the other. The double stacker 18 is an air actuated device that clamps on two opposite sides of the row and lifts the row of articles by means of the cylinder 94. Next on the conveyor is the turn lug 22 which stops one side of the case or preaccumulated row and allows the opposite side to be driven around by the conveyor resulting in an approximately 90 degree turn. Finally, the row travels to the end of the conveyor where it can be either lifted and placed into position by the palletizer or oriented into the upright position. If the pattern requires the upright position, the row is pushed by means of the pusher means 34 over to the side of the conveyor such that one end of the articles partially extends beyond the conveyor 14. Here the ends of the articles are clamped by the upending device 32 and the articles are rotated 90 degrees such that the longest dimension is now vertical.

After the articles are properly oriented for the pattern, the cartesian-style palletizer 26 grips, lifts and places the partial layer onto the pallet. If the articles are positioned standing upright, a restraining device 36 is positioned directly above the pallet. The restraining device consists of a series of spring-loaded rollers located on two opposite sides of the load. The row, or rows, to be palletized are forced down between an opposing set of rollers and held into position until the complete layer is palletized. The restraining rollers are mounted on a frame which is electrically driven to rotate about the same axis as the turntable supporting the unitized load.

After a layer is completed on the pallet, the restraining device moves upward until the spring-loaded rollers are contacting the upper part of the layer. As this happens, the turntable begins to rotate and wrap film around the lower part of the layer. Once the lower part has a continuous wrap around all sides, the turntable and restraining device stop rotating and the restraining device moves upward into position for gripping the bottom of the next layer to be palletized. This sequence is continued until the full load is palletized and wrapped. Then the restraining device moves upward above the load to allow it to be discharged out of the system.

The entire system is controlled by a programmable logic controller which receives inputs for sensing locations of the articles.

The objective and advantage of this invention has been set forth in the foregoing specification. It is contemplated that nuances of design that don't change the conceptual approach to a stacking and wrapping palletizing system as set forth herein are and have been contemplated by the inventors, for instance the use and placement of photo sensors, proximity switches, limit switches and the like may be used to sense the location or presence and absence of articles in the system. This would be the type of item that could be used, and is used in a well known manner on palletizers currently in use, including the preferred embodiment presented herein. Thus the following claims intend to cover the broad concept set forth in the specification as well as nuances of design which may be made to this invention without changing the broad concept presented herein.

What is claimed is:

1. In a palletizer system for stacking layers of articles in a consolidated stack, said palletizer including a stacking station and an integral wrapping station having a turntable upon which said layers are vertically stacked and which station wraps each said layer on said turntable as the layers are being stacked, the improvement comprising restraining means for restraining unstable articles on said stacking station prior to the wrapping of said unstable articles on said stacking station, said restraining means having a supporting frame, means for vertically moving said frame on a vertical mast adjacent said stacking station relative said turntable, said frame means supporting a rotatable circular plate, means for rotating said circular plate, said circular plate defining a rectangular opening therein, said rectangular opening equipped with article guide means for resiliently supporting a stacked layer of said articles prior to and during partial wrapping of said articles at said integral wrapping station.

2. The invention in accordance with claim 1 wherein said palletizing system includes upender means upstream in said system from said stacking station, said upender means having means to receive articles in a first displacement and to rotate said articles to a second displacement.

3. The invention in accordance with claim 1 wherein said palletizer system includes double stacker means upstream in said system from said stacking station, said double stacker having means to grasp and lift a first set of said articles and place said first set of articles on top of a second set of said articles.

* * * * *